US008465594B1

(12) United States Patent
Harder

(10) Patent No.: US 8,465,594 B1
(45) Date of Patent: Jun. 18, 2013

(54) BATTERY JUMPER CABLES WITH INTEGRAL WIRE BRUSH

(76) Inventor: Bronsson Harder, Langley (CA)

( * ) Notice: Subject to any disclaimer, the term of this patent is extended or adjusted under 35 U.S.C. 154(b) by 375 days.

(21) Appl. No.: 12/797,666

(22) Filed: Jun. 10, 2010

(51) Int. Cl.
*B08B 1/00* (2006.01)
*A46B 15/00* (2006.01)
*H01R 11/00* (2006.01)

(52) U.S. Cl.
USPC ..... 134/6; 134/42; 15/106; 15/111; 15/160; 439/503; 439/504; 439/506

(58) Field of Classification Search
USPC ..... 134/6, 42; 15/104.04, 105, 106, 15/111, 160; 439/503, 504, 506
See application file for complete search history.

(56) References Cited

U.S. PATENT DOCUMENTS 2,405,680 A * 8/1946 Williams ..... 451/480
3,678,438 A 7/1972 Gamson
3,745,622 A 7/1973 DeAmicis
4,255,828 A 3/1981 Colla
4,494,812 A 1/1985 Bolton
4,897,044 A * 1/1990 Rood ..... 439/504
4,934,957 A 6/1990 Bellusci
5,295,278 A * 3/1994 Condon et al. ..... 15/104.04
5,297,977 A 3/1994 Lamper
5,435,759 A 7/1995 Adams et al.
5,513,411 A * 5/1996 Simon ..... 15/111
5,679,067 A * 10/1997 Johnson et al. ..... 451/527

* cited by examiner

*Primary Examiner* — Michael Barr
*Assistant Examiner* — Natasha Campbell
(74) *Attorney, Agent, or Firm* — Montgomery Patent & Design; Robert C. Montgomery

(57) ABSTRACT

Motor vehicle jumper cables comprising an integral wire brush mounted on an interior portion of the clamp assemblies is herein disclosed. The jumper cables with the wire brush are to be motioned to remove battery terminal corrosion, thereby providing for a better electrical connection. The device resembles a standard pair of jumper cables used to aid in jump-starting a motor vehicle with a dead battery and comprises a small wire brush located inside of each jaw area. The bristles are made of conductive steel or copper of a sufficient stiffness to clean any corrosion from the battery terminals as the clamps are being installed. Due to the conductive nature of the bristles, current will flow through the bristles as well as the clamp body, thus improving charging and starting ability.

16 Claims, 3 Drawing Sheets

WHEREIN AN UPPER SURFACE OF SAID FIRST JAW AND A BOTTOM SURFACE OF SAID SECOND JAW SHIELD SAID FIRST AND SECOND CLAMP BODIES IN SUCH A MANNER THAT EXTERNAL FLUID AND DEBRIS ARE NOT PENETRATABLE THROUGH SAID UPPER SURFACE OF SAID FIRST JAW AND SAID BOTTOM SURFACE OF SAID SECOND JAW

WHEREIN AN UPPER SURFACE OF SAID FIRST JAW AND A BOTTOM SURFACE OF SAID SECOND JAW SHIELD SAID FIRST AND SECOND CLAMP BODIES IN SUCH A MANNER THAT EXTERNAL FLUID AND DEBRIS ARE NOT PENETRATABLE THROUGH SAID UPPER SURFACE OF SAID FIRST JAW AND SAID BOTTOM SURFACE OF SAID SECOND JAW

BATTERY JUMPER CABLES WITH INTEGRAL WIRE BRUSH

RELATED APPLICATIONS

The present invention was first described in a notarized Official Record of Invention on May 7, 2009, that is on file at the offices of Montgomery Patent and Design, LLC, the entire disclosures of which are incorporated herein by reference.

FIELD OF THE INVENTION

The present invention relates generally to battery jumper cables for automobiles, and in particular, to battery jumper cables with integral wire brushes for secure connection of battery terminals and the like.

BACKGROUND OF THE INVENTION

Conventional vehicle batteries, due to the nature of their construction, are prone to going dead after an extended period of time of non-use. These problems can be aggravated in certain conditions such as cold weather and the like. Additionally, modern vehicles include many features such as lights, radios, and the like which are able to run while the car engine is not running. It is not uncommon for users to accidently leave such features running overnight, thereby draining the car battery and resulting in an unusable vehicle.

The most common solution to the problem of a dead vehicle battery is to jump start the vehicle by connecting the terminals of the battery to those of another running vehicle, thereby providing the initial electrical power needed to start the engine. However, this process is already difficult due to the need for another vehicle, the short length of many conventional jumper cables, and the difficult of securely connecting the terminals together. When corrosion is present on the terminals of one or both batteries, establishing a sufficient electrically conductive connection between the vehicles may be impossible.

Various attempts have been made to provide jumper cables for connection of battery terminals and the like. Examples of these attempts can be seen by reference to several U.S. Pat. Nos. 3,678,438, 4,934,957, and 5,297,977 provide examples of several types of conventional jumper cable connections utilized in the connection of vehicles during jumping starting processes.

While these devices fulfill their respective, particular objectives, each of these references suffer from one (1) or more of the aforementioned disadvantages. Many such devices are not operable in conditions where battery terminals are damaged or corroded. Also, many such devices require additional tools, time, or persons in order to operate under such conditions. Accordingly, there exists a need for a battery jump cable system without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide a battery jumper cable with an inherent capability to provide a secure, stable electrical connection between terminals in cases where corrosion is present. Thus, the object of the present invention is to solve the aforementioned disadvantages and provide for this need.

To achieve the above objectives, it is an object of the present invention to comprise a jumper cable system which provides an integral means for cleaning battery terminals and grounded jumper connections.

Another object of the present invention is to provide conventional jumper cable functionality including a visual means to identify correct electrical polarity via contrasting colors, insulated handles, and a plurality of clamps.

Yet still another object of the present invention is to provide integral corrosion removal and cleaning capabilities via a plurality of integrally mounted brush assemblies. Each brush assembly comprises a wire brush portion which is mounted to the jaws of a clamp via a pair of mounting apertures and a pair of mounting pin portions.

Yet still another object of the present invention is to provide efficient conduction of electric current between the cables and the objects to which the cables are attached such as battery terminals, vehicle body appendages, or the like. The brush assemblies are constructed of an electrically conductive material such as copper, brass, or steel in order to provide an efficient connection.

Yet still another object of the present invention is to comprise various brush assemblies in order to provide easy brushing capabilities for a variety of common applications including interior mounted brush assemblies, exterior mounted brush assemblies, and an exterior rounded brush portion adapted for use with conventional round battery terminals.

Yet still another object of the present invention is to provide a method of utilizing the device that provides a unique means of utilizing the integral brush assemblies in order to provide clean, conductive surfaces for connection of the jumper cables, and connecting the jumper cables in a conventional manner via the clamps in order to provide a secure electrical connection between desired battery terminals, vehicle body appendages, and the like.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
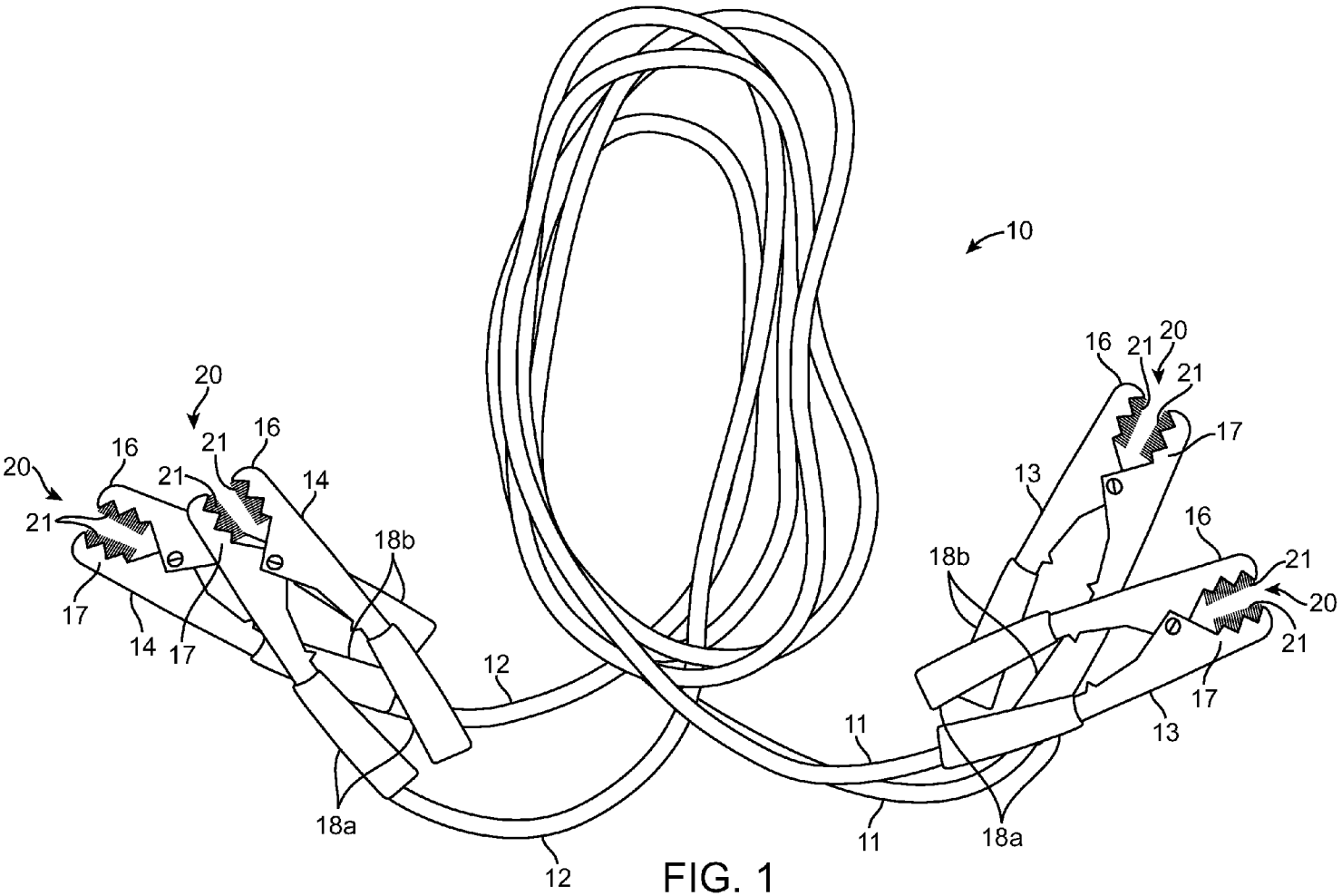
FIG. 1 is an overall view of jumper cable system 10 comprising a plurality of integral wire brushes 20, according to a preferred embodiment of the present invention.

10 jumper cable system
11 first cable
12 second cable
13 first clamp body
14 second clamp body
15 mounting aperture
16 first jaw
17 second jaw
18*a* first handle insulation
18*b* second handle insulation
19 pivot pin
20 brush assembly
21 wire brush
22 brush base
23 mounting pins
30 first alternate brush assembly
31 first alternate wire brush
32 first alternate brush base
33 first alternate clamp body
40 second alternate brush assembly
41 second alternate wire brush
42 spring clip

DETAILED DESCRIPTION OF THE PREFERRED EMBODIMENT

Figure 2A:
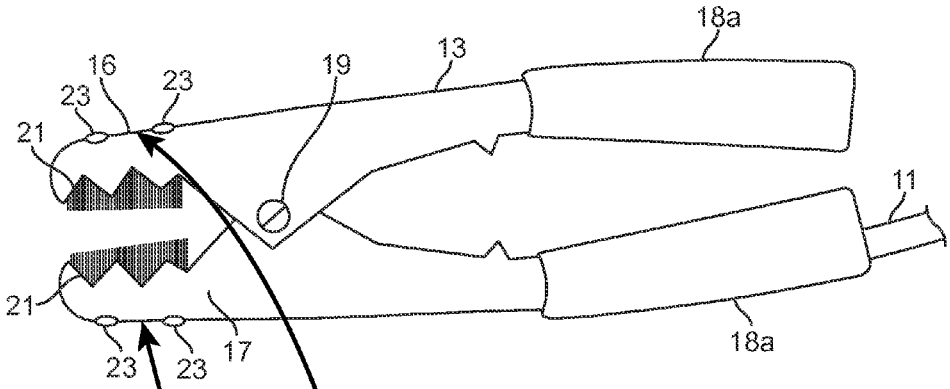
FIG. 2A is a side view of a first clamp body 13 of the jumper cable system 10, according to a preferred embodiment of the present invention.
Figure 2B:
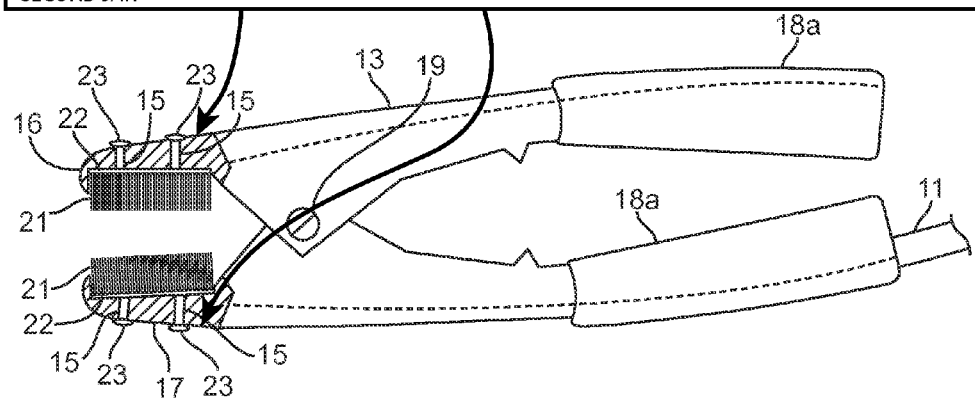
FIG. 2B is a partially cut-away side view of the first clamp body 13 of the jumper cable system 10, according to a preferred embodiment of the present invention.
Figure 2C:
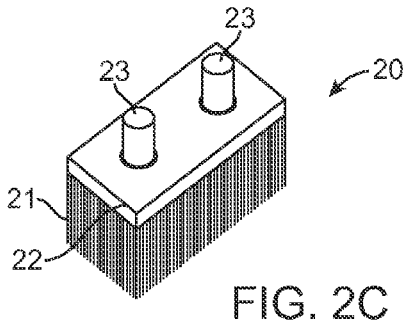
FIG. 2C is a close-up perspective view of a brush assembly 20 of the jumper cable system 10, according to a preferred embodiment of the present invention.
Figure 3:
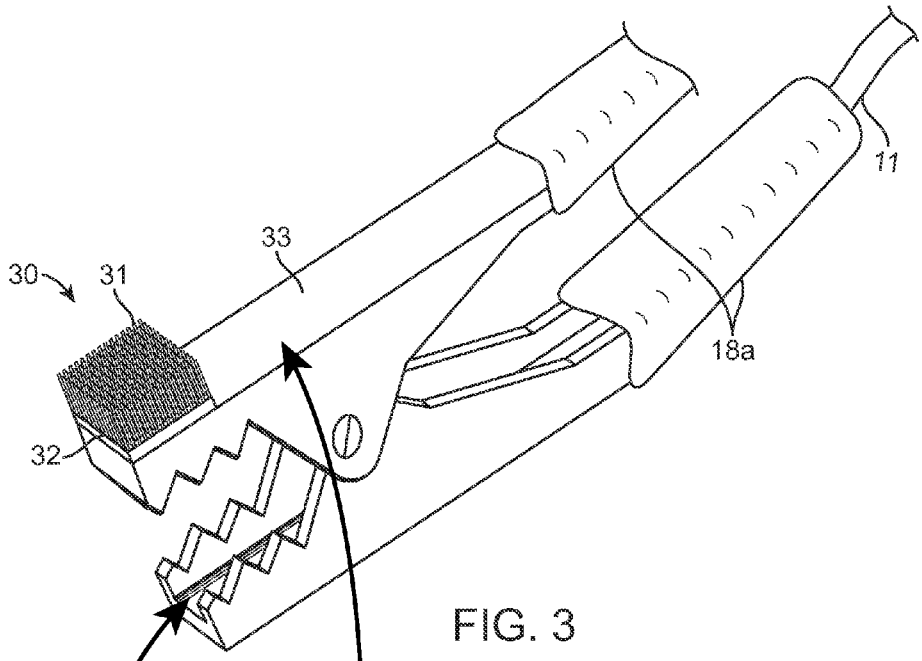
FIG. 3 is a perspective view of a first alternate integral brush assembly 30, according to a first alternate embodiment of the present invention; and, FIG. 4 is a perspective view of a second alternate integral brush assembly 40, according to a first alternate embodiment of the present invention.
Figure 4:
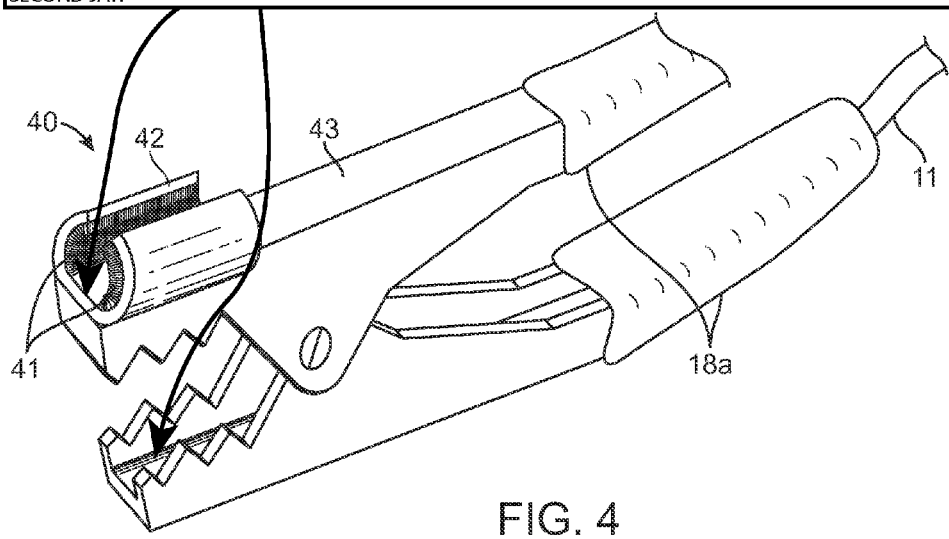

The best mode for carrying out the invention is presented in terms of its preferred embodiment, herein depicted within FIGS. 1 through 2C, and in terms of its alternate embodiments, herein depicted within FIGS. 3 and 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a jumper cable system (herein described as the "system") 10, which provides an integral means for cleaning battery terminals and grounded jumper connections.

Referring now to FIG. 1, an overall view of the system 10, according to the preferred embodiment of the present invention, is disclosed. The system 10 comprises a first cable 11 and a second cable 12 wherein each end of the first cable 11 comprises a first clamp body 13 and each end of the second cable 12 comprise a second clamp body 14. Each interior portion of a first jaw 16 and of a second jaw 17 of each first clamp body 13 and of each second clamp body 14 comprises an integrally mounted brush assembly 20. It is envisioned that the mounting of the brush assembly 20 is to be accomplished by a manufacturer of the system 10. The system 10 is illustrated here depicting each jaw 16, 17 containing a brush assembly 20; however, it is understood that the system 10 may also be provided having the integrally mounted brush assembly 20 within the interior portion of only the first jaw 16 while the second jaw 17 would remain in a "brush-less" state, thereby offering a low-cost model of the system 10. The clamp bodies 13, 14 and the brush assembly 20 comprise electrically conductive materials such as copper, brass, aluminum, steel, or the like, thereby providing efficient conduction of electric current between the cables 11, 12 and thereto objects with which said components are attached thereto such as battery terminals, vehicle body appendages, and the like.

The clamp bodies 13, 14 comprise a visual means to identify correct electrical polarity in a conventional manner via a contrastingly colored first handle insulation 18*a* and a second handle insulation 18*b*. The first handle insulation 18*a* is envisioned to comprise a molded or colored red plastic or rubber covering, thereby indicating a positive pole. Contrastingly, the second handle insulation 18*b* comprises a molded or colored black covering indicating a negative pole. Said handle insulation 18*a*, 18*b* comprises a cylindrical covering over an entire gripping area of each clamp body 13, 14 being affixed thereto using common adhesives.

Referring now to FIGS. 2A and 2B, side views of a first clamp body portion 13 of the system 10, according to the preferred embodiment of the present invention, is disclosed. The first clamp body 13 comprises the first jaw 16 and the second jaw 17 hingedly connected at a central location using a pivot pin 19 wherein the inside portion of each jaw 16 and 17 comprises one (1) integrally mounted brush assembly 20. The wall thickness of the upper portion of the first jaw 16 and of the lower portion of the second jaw 17 each comprise a pair of mounting apertures 15. Integral mounting of the brush assembly 20 thereto the inside portion of each jaw 16, 17 is accomplished by inserting a pair of mounting pin portions 23, being integral thereto each brush assembly 20, through the corresponding mounting apertures 15 and securing the brush assembly 20 onto the inside portion of the jaw 16 and the jaw 17 with a fastening means such as riveting, spot welding, brazing, orbital upsetting, or laser welding, thereby fastening the protruding upper ends of the mounting pins 23 and ensuring a secure mechanical assembly and an integral electrical contact between the brush assembly 20 and the structure of the jaw 16 and of the jaw 17.

Referring now to FIG. 2C, a close-up perspective view of a brush assembly portion 20 of the system 10, according to the preferred embodiment of the present invention, is disclosed. The brush assembly 20 comprises a wire brush 21 portion comprising a plurality of metal bristles made of an electricity conducting material such as: brass, copper, mild steel, or the like. The brush assembly 20 comprises a flat rectangular base 22 which further comprises a pair of integral mounting pins 23 which extend perpendicularly therefrom. It is envisioned that the pins 23 are permanently attached onto the base 22 by processes such as: stud welding, brazing, riveting, or by machining the base 22 and pins 23 from a single piece of metal bar stock.

Referring now to FIG. 3, a perspective view of a first alternate brush assembly 30 according to a first alternate embodiment of the present invention, is disclosed. The first alternate brush assembly 30 comprises a first alternate wire brush 31, a first alternate brush base 32 and a first alternate clamp body 33. It is envisioned that the first alternate brush assembly 30 is made of materials similar to those of the brush assembly 20 comprised within the preferred embodiment 10 using mounting pins 23 or equivalent fastening means such as welding, brazing or riveting. The first alternate brush assembly 30 in turn is integrally fastened in like manner as the preferred embodiment 10 onto each clamp body 33 of the jumper cable system 10. It is envisioned that the mounting of the first alternate brush assembly 30 onto the first alternate clamp body 33 is to be accomplished by the manufacturer of the system 10.

Referring now to FIG. 4, a perspective view of a second alternate brush assembly 40, according to a second alternate embodiment of the present invention, is disclosed. The second alternate brush assembly 40 comprises a second alternate wire brush 41 encircled thereby a spring clip 42, wherein the spring clip 42 is permanently fastened thereonto each second alternate clamp 43 of the jumper cable system 10 by mounting pins 23, rivets, or screws. Whereas the second alternate wire brush 41 portion is envisioned to be made of materials similar to those of the brush assembly 20 comprised within the preferred embodiment 10, the configuration of the encircling spring clip 42 is intended to allow the second alternate wire brush 41 to accommodate the configuration of a cylindrical shaped terminal to be cleaned. Two (2) pairs of similarly configured first alternate clamp bodies 43 are intended to be comprised within a jumper cable system 10. It is envisioned that the mounting of the second alternate brush assembly 40 onto the second alternate clamp 43 is to be accomplished by the manufacturer of the system 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed in a manner similar to the safe installation of any jumper cable system 10.

The method of utilizing the system 10 may be achieved by performing the following steps: unrolling and untangling the assembly of first cable 11 and the second cable 12 of the system 10; aligning the system 10 between a discharged battery and a charging battery; gripping one (1) second clamp body 14 of the second cable 12; keeping the second clamp 14 in a near-open state; motioning the pair of wire brushes 21 in an upward-downward or back-and-forth rotational direction to clean a grounded terminal on the discharged battery; releasing the second clamp 14 to allow it to grip the cleaned terminal of the discharged battery; repeating the procedure on a grounded terminal at the charging side; following a similar cleaning and clamping procedure by using one first clamp 13 on the positive terminal of the discharged battery; finalizing the positive to positive connection between the discharged battery and the charging battery by means of the first cable 11 and the remaining first clamp 13 by following the similar cleaning and clamping procedure; allowing the charging battery time to initiate the charging process; starting the engine of the charging side; starting the engine of the discharged side; leaving the discharged side engine running; turning off the charging engine; disconnecting the clamps 13 and 14 in a reverse order; and, appropriately storing the system 10.

While performing the charging task described above, it is important to observe that the first 13 and second 14 clamp bodies comprising the red first handle insulation portions 18*a* thereto the corresponding positive poles of the discharged and charging batteries and connecting the first 13 and second 14 clamp bodies comprising the black second handle insulation portions 18*b* thereto the corresponding negative poles of the discharged and charging batteries.

The method of utilizing the first alternate brush assembly 30 may be achieved by using the first alternate clamp body 33 as a handle for the integral first alternate brush assembly 30 and cleaning the corresponding terminals by wire brushing them to a bright corrosion-free state before performing the subsequent steps of connecting each pair of like-polarity terminals to each other.

The method of utilizing the second alternate brush assembly 40 may be achieved by using the second alternate clamp body 43 as a handle for the integral second alternate brush assembly 40 and cleaning the corresponding terminals by wire brushing them to a bright corrosion-free state before performing the subsequent steps of connecting each pair of like-polarity terminals to each other.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A battery jumper system for cleaning battery terminals and grounded jumper connections, said battery jumper system comprising:

first and second cables;

a plurality of first clamp bodies mated at each end of said first cable;

a plurality of second clamp bodies mated at each end of said second cable; and, a plurality of brush assemblies attached to said first and second clamp bodies respectively;

wherein said first and second clamp bodies and said brush assemblies are formed from electrically conductive materials and thereby conduct electric current between said first and second cables respectively;

wherein each of said first and second clamp bodies comprises first and second jaws; and, wherein an upper surface of said first jaw and a bottom surface of said second jaw shield said first and second clamp bodies in such a manner that external fluid and debris are not penetrable through said upper surface of said first jaw and said bottom surface of said second jaw.

2. The battery jumper system of claim 1, wherein each of said first and second clamp bodies further comprises:

first and second handle insulations;

said first and second jaws having a plurality of mounting apertures formed therein; and, a pivot pin pivotally mated to said first and second jaws such that said first jaw and said second jaw are hingedly connected at a central location by said pivot pin.

3. The battery jumper system of claim 2, wherein said first and second handle insulations have unique colors for identifying a polarity of the electric current;

wherein said first handle insulation includes a red covering indicating a positive pole and said second handle insulation includes a black covering indicating a negative pole; and, wherein said first and second handle insulations cover an entire gripping area of said first and second clamp bodies respectively.

4. The battery jumper system of claim 2, wherein said mounting apertures extend through a wall of said upper portion of said first jaw and a wall of said lower portion of said second jaw respectively.

5. The battery jumper system of claim 2, wherein each of said brush assemblies comprises:

a flat rectangular base;

a plurality of mounting pin portions attached to said rectangular base; and, a wire brush.

6. The battery jumper system of claim 5, wherein each of said brush assemblies is integrally mounted at an inside portion of said first and second jaws of said first and second clamp bodies respectively;

wherein said mounting pin portions are inserted through said mounting apertures and thereby fasten protruding upper ends of said mounting pins to said first and second jaws respectively; and, wherein said wire brush has a plurality of electrically conductive metal bristles selected from a group including brass, copper and mild steel.

7. The battery jumper system of claim 5, wherein one of said brush assemblies is integrally mounted at an outside portion of one of said first clamp bodies; wherein said one brush assembly comprises: a spring clip permanently fastened onto one of said second clamp bodies such that said wire brush accommodates a cylindrical shaped configuration.

8. A battery jumper system for cleaning battery terminals and grounded jumper connections, said battery jumper system comprising:

first and second cables;

a plurality of first clamp bodies integrally mated at each end of said first cable;

a plurality of second clamp bodies integrally mated at each end of said second cable; and, a plurality of brush assemblies statically attached to said first and second clamp bodies respectively;

wherein said first and second clamp bodies and said brush assemblies are formed from electrically conductive materials and thereby conduct electric current between said first and second cables respectively;

wherein each of said first and second clamp bodies comprises first and second jaws; and, wherein an upper surface of said first jaw and a bottom surface of said second jaw shield said first and second clamp bodies in such a manner that external fluid and debris are not penetrable through said upper surface of said first jaw and said bottom surface of said second jaw.

9. The battery jumper system of claim 8, wherein each of said first and second clamp bodies further comprises:

first and second handle insulations;

said first and second jaws having a plurality of mounting apertures formed therein; and, a pivot pin pivotally mated to said first and second jaws such that said first jaw and said second jaw are hingedly connected at a central location by said pivot pin.

10. The battery jumper system of claim 9, wherein said first and second handle insulations have unique colors for identifying a polarity of the electric current;

wherein said first handle insulation includes a red covering indicating a positive pole and said second handle insulation includes a black covering indicating a negative pole; and, wherein said first and second handle insulations cover an entire gripping area of said first and second clamp bodies respectively.

11. The battery jumper system of claim 9, wherein said mounting apertures extend through a wall of said upper portion of said first jaw and a wall of said lower portion of said second jaw respectively.

12. The battery jumper system of claim 9, wherein each of said brush assemblies comprises:

a flat rectangular base;

a plurality of mounting pin portions attached to said rectangular base; and, a wire brush.

13. The battery jumper system of claim 12, wherein each of said brush assemblies is integrally mounted at an inside portion of said first and second jaws of said first and second clamp bodies respectively;

wherein said mounting pin portions are inserted through said mounting apertures and thereby fasten protruding upper ends of said mounting pins to said first and second jaws respectively; and, wherein said wire brush has a plurality of electrically conductive metal bristles selected from a group including brass, copper and mild steel.

14. The battery jumper system of claim 12, wherein one of said brush assemblies is integrally mounted at an outside portion of one of said first clamp bodies;

wherein said one brush assembly comprises: a spring clip permanently fastened onto one of said second clamp bodies such that said wire brush accommodates a cylindrical shaped configuration.

15. A method of utilizing a battery jumper system for cleaning battery terminals and grounded jumper connections, said method comprising the steps of:

providing first and second cables;

providing and integrally mating a plurality of first clamp bodies at each end of said first cable;

providing and integrally mating a plurality of second clamp bodies at each end of said second cable;

providing and statically attaching a plurality of brush assemblies to said first and second clamp bodies respectively, wherein said first and second clamp bodies and said brush assemblies are formed from electrically conductive materials; and, conducting electric current between said first and second cables respectively;

wherein each of said first and second clamp bodies comprises first and second jaws; and, wherein an upper surface of said first jaw and a bottom surface of said second jaw shield said first and second clamp bodies in such a manner that external fluid and debris are not penetrable through said upper surface of said first jaw and said bottom surface of said second jaw.

16. The method of claim 15, further comprising the steps of: cleaning a grounded terminal on a discharged battery by performing the following sub-steps:

a. motioning a first one of said brush assemblies in at least one of an upward-downward and back-and-forth rotational direction along the grounded terminal of the discharged battery;

b. gripping the cleaned terminal of the discharged battery with a second one of said brush assemblies; and, c. repeating steps a. and b. on a grounded terminal at a charging side of the discharged battery.

* * * * *